United States Patent [19]

Moore et al.

[11] 4,180,373

[45] Dec. 25, 1979

[54] TURBINE BLADE

[75] Inventors: William A. Moore, Durham, Conn.; Hans R. Przirembel, Jupiter, Fla.

[73] Assignee: United Technologies Corporation, Hartford, Conn.

[21] Appl. No.: 865,171

[22] Filed: Dec. 28, 1977

[51] Int. Cl.[2] ..... F01D 5/18

[52] U.S. Cl. ..... 416/97 R; 415/115

[58] Field of Search ..... 416/96 R, 97 R; 415/115

[56] References Cited

U.S. PATENT DOCUMENTS

| | | | |
|---|---|---|---|
| 3,533,711 | 10/1970 | Kercher | 416/97 X |
| 3,628,800 | 12/1971 | Smuland et al. | 416/97 X |
| 3,628,885 | 12/1971 | Sidenstick et al. | 416/97 |
| 4,019,831 | 4/1977 | Franklin et al. | 416/97 R |
| 4,073,599 | 2/1978 | Allen et al. | 416/97 R |

FOREIGN PATENT DOCUMENTS

| | | | |
|---|---|---|---|
| 1366704 | 9/1974 | United Kingdom | 416/97 |
| 358525 | 1/1973 | U.S.S.R. | 416/97 |
| 364747 | 3/1973 | U.S.S.R. | 416/97 |
| 444888 | 11/1974 | U.S.S.R. | 416/92 |

*Primary Examiner*—Everette A. Powell, Jr.

*Attorney, Agent, or Firm*—McCormick, Paulding & Huber

[57] ABSTRACT

A convectively cooled turbine blade has two distinct cooling air passage systems. The first system cools the blade leading edge and emits cooling air through outlet passageways in the leading edge arranged in showerhead array. The second system includes a three-pass series flow passage through the remainder of the blade. Air flow from the second system emits along the trailing edge through an array of slots generally configured in the form of a Venetian blind.

4 Claims, 3 Drawing Figures

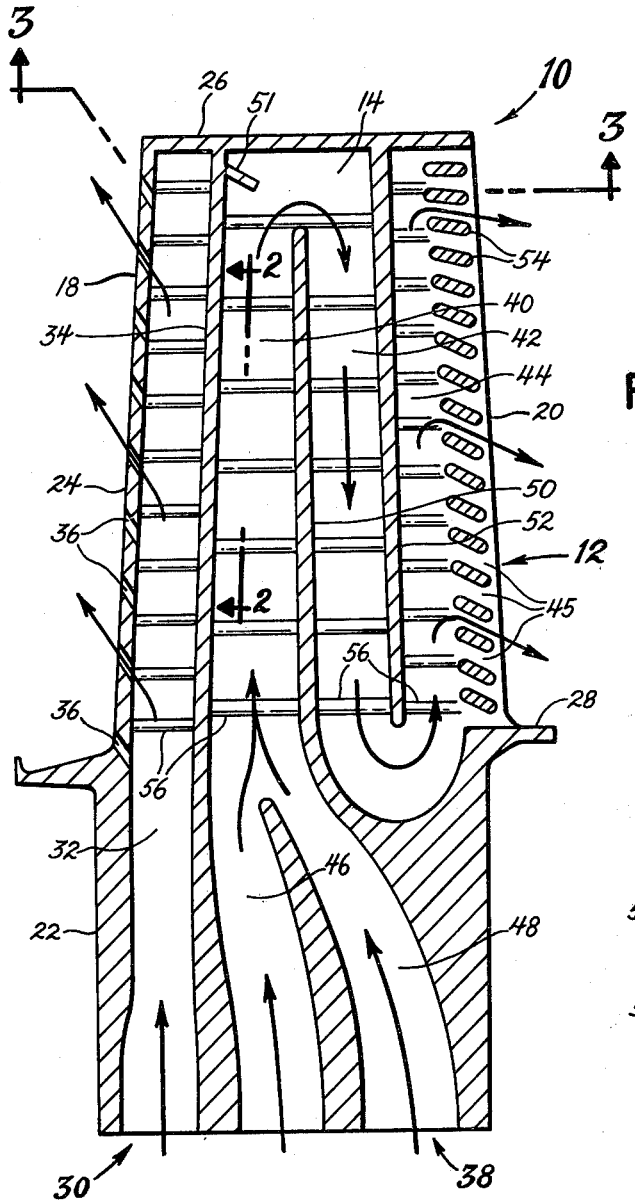
Fig. 1
Fig. 2
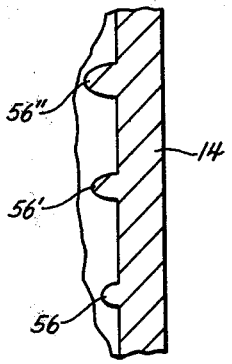
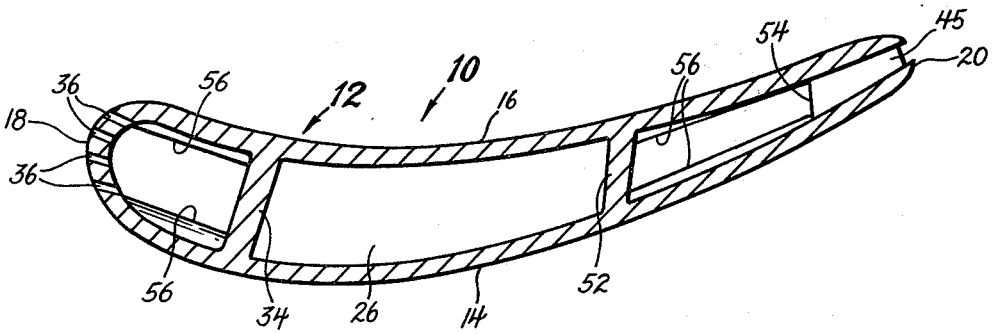
Fig. 3

TURBINE BLADE

BACKGROUND OF THE INVENTION

This invention relates in general to turbine blades and deals more particularly with an improved convectively cooled turbine blade particularly adapted for use in the first stage of a gas turbine engine.

In gas turbine engines and the like a turbine operated by burning gases drives a blower or compressor which furnishes air to a burner. Such turbine engines operate at relatively high temperatures. The capacity of such an engine is limited to a large extent by the ability of the material from which the turbine blades are made to withstand thermal stresses which develop at such relatively high operating temperatures. To enable higher operating temperatures and increased engine efficiency without risk of blade failure hollow convectively cooled turbine blades are frequently utilized. Such blades generally have intricate interior passageways which provide torturous flow paths to assure efficient cooling whereby all portions of the blades may be maintained at relatively uniform temperature. However, such blades are difficult and expensive to manufacture. The present invention is concerned with this problem, and it is the general aim of this invention to provide an improved convectively cooled turbine blade which satisfies required design criteria and which may be manufactured at relatively low cost.

SUMMARY OF THE INVENTION

In accordance with the present invention, an improved convectively cooled turbine blade is provided which includes two distinct air cooling passageway systems. One of the passageway systems has an inlet opening at the root end of the blade and includes a first fluid passage which extends longitudinally of the blade in the region of its leading edge and terminates within the blade adjacent its tip. At least one longitudinally spaced series of first outlet passages open through the leading edge of the blade and communicate with the first fluid passage. The second passageway system also opens through the root end of the turbine blade and includes a plurality of longitudinally extending passage sections which define a serpentine flow path through the remainder of the turbine blade and which communicate with an array of slots arranged in a Venetian blind configuration in the trailing edge of the blade.

BRIEF DESCRIPTION OF THE DRAWING

FIG. 1 is a longitudinal sectional view of an airfoil shaped turbine blade embodying the present invention.

FIG. 2 is a somewhat enlarged fragmentary sectional view taken along the line 2—2 of FIG. 1.

FIG. 3 is a somewhat enlarged sectional view taken along the line 3—3 of FIG. 1.

DETAILED DESCRIPTION OF PREFERRED EMBODIMENT

Turning now to the drawing, the invention is illustrated and described with reference to an air cooled turbine blade, designated generally by the numeral 10, and particularly adapted for use in the first stage of an axial flow gas turbine engine (not shown) which has a plurality of airfoil shaped turbine rotor blades mounted in angularly spaced relation on a rotor disc. The turbine blade 10 has a more or less conventional outer configuration and comprises a hollow elongated body, indicated generally at 12, which includes a concave inner side wall 14 and an opposing convex outer side wall 16. The side walls terminate at longitudinally extending leading and trailing edges indicated, respectively at 18 and 20. The body 12 further includes a root portion 22 at one end and elongated blade portion 24 which extends from the root portion and terminates at a tip 26, which is closed by a separately inserted tip cap (not shown). A platform 28 extends outwardly from the body at the junction between the root and blade portions. The root portion is preferably provided with attachment shoulders (not shown) which may have a conventional fir tree configuration for mounting the turbine blade 10 in complementary slots in a rotor disc.

In accordance with the present invention, two distinct cooling air passageway systems are provided for convectively cooling the balde 10. The first passageway system, designated generally by the numeral 30, includes a substantially straight longitudinally extending first passage 32 which opens through the root end of the blade and extends through the root portion and into the blade portion within the region of the leading edge 24. The passage 32 is defined, in part, by a partition or wall rib 34 which is disposed between the side walls 14 and 16 and which extends between the root and tip ends of the turbine blade 10 in generally parallel relation to the leading edge 18, as shown in FIG. 1. At least one longitudinally spaced series of fluid outlet passageways 36, 36 extend through the leading edge 18 and communicate with the passage 32. Preferably, and as shown, four transversely spaced rows of outlet passages 36, 36 are formed in the leading edge 18 as best shown in FIG. 3. The outlet passages 36, 36 are outwardly inclined to the longitudinal axis of the blade 10 and in a direction away from the root end of the blade and terminate in a showerhead array of passage openings in the leading edge 18.

The turbine blade 10 further includes a second distinct passageway system indicated generally at 38 and which generally comprises a plurality of longitudinally extending and series connected passage sections 40, 42 and 44 which provide a three-pass flow passage between the root end of the turbine blade 10 and an array of outlet passages or slots 45, 45 formed in the trailing edge 20. The passageway system 38 further includes two inlet branch passages 46 and 48 which are disposed within the root portion 22 and open through the root end of the turbine blade 10. The branch passages 46 and 48 merge with the passage section 40 proximate the junction between the root protion 22 and the blade portion 24.

The passageway section 40 is defined, in part, by the wall rib 34 and by another longitudinally extending partition or wall rib 50 which is disposed between the side walls 14 and 16 and which extends from the root portion 22 toward the tip 26 in generally parallel relation to the rib 34. The wall rib 50 terminates in spaced relation to the tip 26 to provide fluid communication between the passageway sections 40 and 42. A turbulator member 51 projects from the wall rib 34 and into the passage 40 near the junction of the wall rib 34 and the tip 26. The latter member extends into the passageway section 40 between the side walls 14 and 16 and is inclined to the longitudinal axis of the turbine blade, substantially as shown in FIG. 1. The passage 42 is defined, in part, by the wall rib 50 and by another longitudinally extending partition or wall rib 52 which is disposed between the side walls 14 and 16 and which extends from the tip 26 in the direction of the root end and terminates in spaced relation to the root portion 22 near the junction of the root and blade portions 22 and 24 to provide fluid communication with the passage section 44. The passage section 44, designated as the terminal passage, is defined, in part, by the wall rib 52 and extends through the blade portion in the trailing edge region and in generally parallel relation with the trailing edge 20. The slots 45, 45 which communicate with the passage section 44 are defined by a plurality of partitions or pedestal members 54, 54 arranged in Venetian blind array and disposed between the side walls 14 and 16 generally adjacent the trailing edge 20. The pedestal members 54, 54 are outwardly inclined to the longitudinal direction and in a direction away from the tip end of the turbine blade 10. It will be noted that the angles of inclination of the pedestal members 54, 54 change somewhat near the tip end of the turbine blade 10.

A plurality of turbulators or trip strips 56, 56 extend along the side walls 14 and 16 and project into the various passages which comprise the passageway sections 30 and 38. The turbulator strips extend generally transversely of the turbine blade and have cross-sectional contours substantially as shown in FIG. 2. The turbulator strips 56, 56 are of minimum height at the radial inward station, that is the turbulator station nearest the root end of the blade, and progressively increase in height toward the radial outboard station, that is the turbulator station nearest the tip end of the blade.

Preferably, the passageway systems 30 and 38 are constructed and arranged so that one percent of engine air flows through the first passageway section 30 to cool the leading edge portion of the blade and 1.5 percent of engine air flows along a reversing path through the passages which comprise the second passageway system 38 to cool the remainder of the turbine blade 10. Air flows into and through the turbine blade 10 from the rotor disc and in directions indicated by the flow arrows in FIG. 1. More specifically, cooling air from the rotor disc enters the passageway system 30, flows outwardly through the passage 32, and is eventually discharged at the blade leading edge through the showerhead holes 36, 36. Additional air from the rotor disc enters the branch passages 46 and 48 which comprises the passageway system 38 and flows into and through the passage 40 between the wall ribs 34 and 50 and turns about the outer end of the wall rib 50. The turbulator member 51 prevents stagnation at the corner formed by the intersection of the wall rib 34 and the tip wall 26. The cooling air then passes through the passage 42 defined by the wall ribs 50 and 52, travels through the full span of the blade portion, turns about the inner end of the wall rib 52, and flows into the terminal passage 44 and eventually through the trailing edge pedestal slots 45, 45 between the angularly inclined pedestal members 54, 54. The latter pedestal members are angularly arranged to obtain required blockage area for producing the velocities and metering necessary to obtain required metal cooling.

Since the various passages which comprise the passageway systems have relatively large cross-sectional areas and flow Mach numbers are relatively low (subsonic), the trip strips are incorporated to improve convective cooling. Each trip strip 56 produces downstream agitation or turbulance which effectively breaks up the boundry layers and causes the cooling air to scrub the walls of the passages. Further, the surface areas of the various passage walls are increased by the provision of trip strips with a resulting increase in fluid cooling efficiency.

Trip strip goemetry (pitch and height) is optimized with design burner profile to maintain the leading edge and side walls of the turbine blade at temperatures below the permissible maximum metal temperature of 1500° F at peaking operating conditions. The trip strips in the terminal passage 44 allow relatively short pedestal members to be used to define relatively short pedestal slots and also provide a more controlled flow distribution through the various pedestal slots 45, 45. The geometry of the trip strips in the vicinity of the turning areas of the passageway system 38 is also optimized to produce minimum separation and turning loss. Analytical predictions based on scale model testing is used to establish trip strip effectiveness and turning loss magnitude.

We claim:

1. A turbine blade having a hollow elongated body including a root portion at one end and a blade portion extending from said root portion and terminating at a closed tip at the other end of said body, said body including opposing side walls and longitudinally extending leading and trailing edges and having a plurality of generally longitudinally extending wall ribs therein extending between said side walls and partially defining two distinct fluid passageway systems within said body, said passageway systems including a first passageway system having a substantially straight longitudinally extending blind first fluid passage opening through said one end and extending through said root portion into said blade portion and along said leading edge and terminating within said blade portion generally adjacent said tip, said first passageway system having a plurality of transversely spaced rows of longitudinally spaced first outlet passages extending through said leading edge of said blade portion and communicating with said first fluid passage, each of said first outlet passages being inclined to the longitudinal axis of said turbine blade and extending outwardly through said leading edge and in a direction away from said one end, said second fluid passageway system having a three-pass fluid passage including a plurality of generally longitudinally extending and series connected passage sections defining a reversing flow path through the remainder of said body portion, said passage sections including a first passage section in said blade portion and two branch passages in said root portion opening through said one end and merging with each other and with said first passage section at the junction of said root and blade portions, said first passage section and said two brach passages being separated from said first fluid passage by a first one of said wall ribs extending from said one end to said tip and partially defining said first fluid passage, a second passage section adjacent said first section and connected thereto at an outer turning region at said tip end, said second passage section being separated from said first passage section and from said two branch passages by a second one of said wall ribs connected to said root portion at the junction between said root and blade portions and extending toward said tip end in generally parallel relation to said first wall rib and terminating in spaced relation to said closed tip at said outer turning region, and a third passage section connected to said second passage section at an inner turning region proximate the junction of said root and said blade portions and extending within the region of said trailing edge and generally adjacent said second passage section, said third passage section being separated from said second passage section by a third one of said wall ribs extending from said closed tip toward said one end in generally parallel relation to said second wall rib and terminating in spaced relation to said root portion at said inner turning region, said third passage section terminating within said blade portion and adjacent said closed tip, said second fluid passageway system including a longitudinally spaced series of elongated pedestal members disposed between said side walls adjacent said trailing edge and defining a longitudinally spaced series of pedestal slots communicating with said third passage section and opening through said trailing edge, said pedestal slots being inclined to the longitudinal axis of said turbine blade and extending outwardly through said trailing edge and in a direction away from said other end, said side walls having longitudinally spaced and transversely extending trip strips formed thereon, said trip strips projecting from said side walls and into said passageways.

2. A turbine blade as set forth in claim 1 wherein some of said pedestal slots are inclined at different angles to said longitudinal axis than other of said pedestal slots.

3. A turbine blade as set forth in claim 1 wherein said trip strips are arranged in longitudinally spaced series progressively increasing in projected height above said side walls from said one end to said other end of said blade portion.

4. A turbine blade as set forth in claim 1 wherein said body has a turbulator member projecting into said first passage section in said outer turning region proximate the junction of said first wall rib and said tip and inclined in the direction of said trailing edge and toward said one end.

* * * * *

UNITED STATES PATENT AND TRADEMARK OFFICE

CERTIFICATE OF CORRECTION

PATENT NO. : 4,180,373

DATED : December 25, 1979

INVENTOR(S) : William A. Moore and Hans R. Przirembel

It is certified that error appears in the above-identified patent and that said Letters Patent are hereby corrected as shown below:

Column 2, line 17 "balde" should be --blade--.

Column 2, line 50 "protion" should be --portion--.

Column 4, line 51 "brach" should be --branch--.

Signed and Sealed this

*Eighteenth* Day of *March 1980*

[SEAL]

*Attest:*

SIDNEY A. DIAMOND

*Attesting Officer*

*Commissioner of Patents and Trademarks*